US009386873B2

(12) United States Patent
Gouldson

(10) Patent No.: US 9,386,873 B2
(45) Date of Patent: Jul. 12, 2016

(54) TOP GARMENT HANGER WITH REUSABLE SNAP-ON PADS

(71) Applicant: BRAIFORM (HK) LTD., Kowloon Bay (HK)

(72) Inventor: Stanley F. Gouldson, Northport, NY (US)

(73) Assignee: BRAIFORM (HK) LTD., Kowloon Bay (HK)

( * ) Notice: Subject to any disclaimer, the term of this patent is extended or adjusted under 35 U.S.C. 154(b) by 7 days.

(21) Appl. No.: 14/464,929

(22) Filed: Aug. 21, 2014

(65) Prior Publication Data

US 2016/0051072 A1 Feb. 25, 2016

(51) Int. Cl.

| | |
|---|---|
| ***A47G 25/30*** | (2006.01) |
| ***A47G 25/48*** | (2006.01) |
| *A47F 7/19* | (2006.01) |

(52) U.S. Cl.

CPC ..... *A47G 25/30* (2013.01); *A47G 25/482* (2013.01); *A47G 25/486* (2013.01); *A47F 7/19* (2013.01)

(58) Field of Classification Search

CPC ..... A47G 25/26; A47G 25/30; A47G 25/482; A47G 25/486; A47G 2025/1492; A47F 7/19; A41D 27/22

See application file for complete search history.

(56) References Cited

U.S. PATENT DOCUMENTS

| | | | | |
|---|---|---|---|---|
| 2,876,940 | A * | 3/1959 | Reller | A47G 25/486 223/93 |
| 2,913,158 | A * | 11/1959 | Reller | A47G 25/486 223/91 |
| 3,067,917 | A * | 12/1962 | Reller | A47G 25/28 223/91 |
| 6,523,240 | B1 | 2/2003 | Gouldson | |
| 2002/0158091 | A1 * | 10/2002 | Matkovich | A47G 25/48 223/93 |
| 2008/0296324 | A1 * | 12/2008 | Zhao | A47G 25/48 223/93 |

FOREIGN PATENT DOCUMENTS

| | | | |
|---|---|---|---|
| CA | 2460750 | A1 * | 9/2004 |
| DE | 29915753 | U1 * | 11/1999 |
| EP | 1512352 | A1 * | 3/2005 |

* cited by examiner

*Primary Examiner* — Ismael Izaguirre

(74) *Attorney, Agent, or Firm* — Scully Scott Murphy and Presser

(57) ABSTRACT

A combination of a top garment hanger and a reusable snap-on pad is provided. The hanger has a lateral opening formed through the body of the hanger. The lateral opening has an inwardly extending surface for providing a first locking surface. The reusable snap-on pad has a pair of legs and a locking tab provided on an inner surface of each leg. The locking tab has a second locking surface. When the reusable snap-on pad is mounted to the garment hanger, the locking tab enters the lateral opening and the first locking surface and the second locking surface engage each other, to provide a secure fixation of the reusable snap-on pad to the garment hanger. Also, when the reusable snap-on pad is mounted to the garment hanger, a slot is formed between the pad and the hanger for receiving a portion of a garment.

16 Claims, 4 Drawing Sheets

TOP GARMENT HANGER WITH REUSABLE SNAP-ON PADS

BACKGROUND

The present invention relates generally to molded plastic garment hangers as are widely used for the purpose of shipping and displaying garments. More specifically, the present invention relates to top garment hangers with snap-on pads, which permits removal of the pads from the hangers depending on the usable conditions of the pads and the hangers and further permits strategic reuse of the pads and the hangers to save materials. The top garment hangers according to the present invention are environmentally advantageous.

In the area of retail garment sales, so-called Garment-On-Hanger (GOH) programs have become preferred by retailers. In a GOH program, garments are delivered to retail merchants already suspended from hangers, where upon arrival at the retail location the garments are immediately placed on display for sale. One application of the GOH programs is top garments such as T-shirts, polo shirts, jackets and the like. The garments are placed on a hanger and then shipped from the remote destination to the retail establishment.

In particular, retailers have specified particular hangers or hanger characteristics among their several suppliers in order to achieve uniformity on their sales floors. To this end, standards as to hanger size, shape, performance characteristics, etc., are maintained, for example, by organizations such as the Voluntary Inter-industry Commerce Standards Association (VICS). One particular standardized hanger feature is popular across several hanger models, namely a top garment hanger suitable for suspending, shipping and displaying a wide variety of top garments, such as shirts, jackets and the like.

When needed for a specific use, such as for hanging coats, blazers and other heavier garments, a top garment hanger is typically fitted with rubbery pads over-molded along the shoulder portion of the hanger to help retain the garments on the hangers. One problem of the top garments hangers with over-molded strips is that the pads tend to gather dirt, which is difficult to remove, and accordingly become discolored. The soiled hangers with discolored pads do not appeal to potential costumers, and thus have to be replaced by the retailers, even though in many cases the hangers are not soiled and still usable. This causes significant waste of raw materials and energy used to manufacture the hangers, which is not environmentally sound.

Accordingly, there is a need in the industry for improved top garment hangers and non-slip pads, which enable easy, quick and secure attachment of the pads to the hangers while maintaining the reusable characteristics of the pads and the hanger so as to provide an environmentally friendly product.

SUMMARY

According to an exemplary aspect of the present invention, a garment hanger is provided. The garment hanger includes a hook and an elongated hanger body connected to the hook. The hanger body includes a first arm and a second arm extending oppositely from the hook. The hanger body has a top surface for supporting a garment. The hanger further includes a recess formed in the hanger body, the recess extending downwardly from the top surface for providing a space into which a portion of the garment is received. The hanger further includes at least one lateral opening formed in the hanger body, the lateral opening having an inwardly extending surface for providing a locking surface configured to engage a non-slip pad.

According to another exemplary aspect of the present invention, a reusable snap-on pad used with a garment hanger is provided. The reusable snap-on pad includes an elongated body having a first end and an opposite second end. The reusable snap-on pad further includes a pair of legs disposed at the first end of the elongated body and extending downwardly from the elongated body. The pair of legs are substantially parallel with each other and spaced from each other by a predetermined distance. The reusable snap-on pad can further include a protrusion disposed at the second end of the elongated body and extending downwardly from the elongated body. The reusable snap-on pad further includes at least one locking tab disposed on an inner surface of the pair of legs, the at least one locking tab having a locking surface and a transitioning surface connecting the locking surface and the inner surface.

According to still another exemplary aspect of the present invention, a combination of a garment hanger and a reusable snap-on pad is provided. The hanger includes a hook and an elongated hanger body connected to the hook. The hanger body includes a first arm and a second arm extending oppositely from the hook, and a top surface for supporting a garment. The hanger further includes a recess formed in the hanger body, the recess extending downwardly from the top surface; and at least one lateral opening formed in the hanger body, the lateral opening having an inwardly extending surface for providing a first locking surface. The snap-on pad includes an elongated body having a first end and an opposite second end, a pair of legs disposed at the first end of the elongated body and extending downwardly from the elongated body. The pair of legs are substantially parallel with each other and spaced from each other by a predetermined distance. The reusable snap-on pads further include at least one locking tab disposed on an inner surface of the pair of legs, the at least one locking tab having a second locking surface and a transitioning surface connecting the second locking surface and the inner surface. When the reusable snap-on pad is mounted to the garment hanger, the at least one locking tab enters the at least one lateral opening and the first locking surface and the second locking surface engage each other, to provide a secure fixation of the reusable snap-on pad to the garment hanger.

BRIEF DESCRIPTION OF THE DRAWINGS

These and other features, aspects and benefits of the present invention will be made apparent with reference to the following specification and accompanying drawings, where like reference numerals refer to like features across the several views, and wherein.

DETAILED DESCRIPTION OF THE EMBODIMENTS

Figure 1:
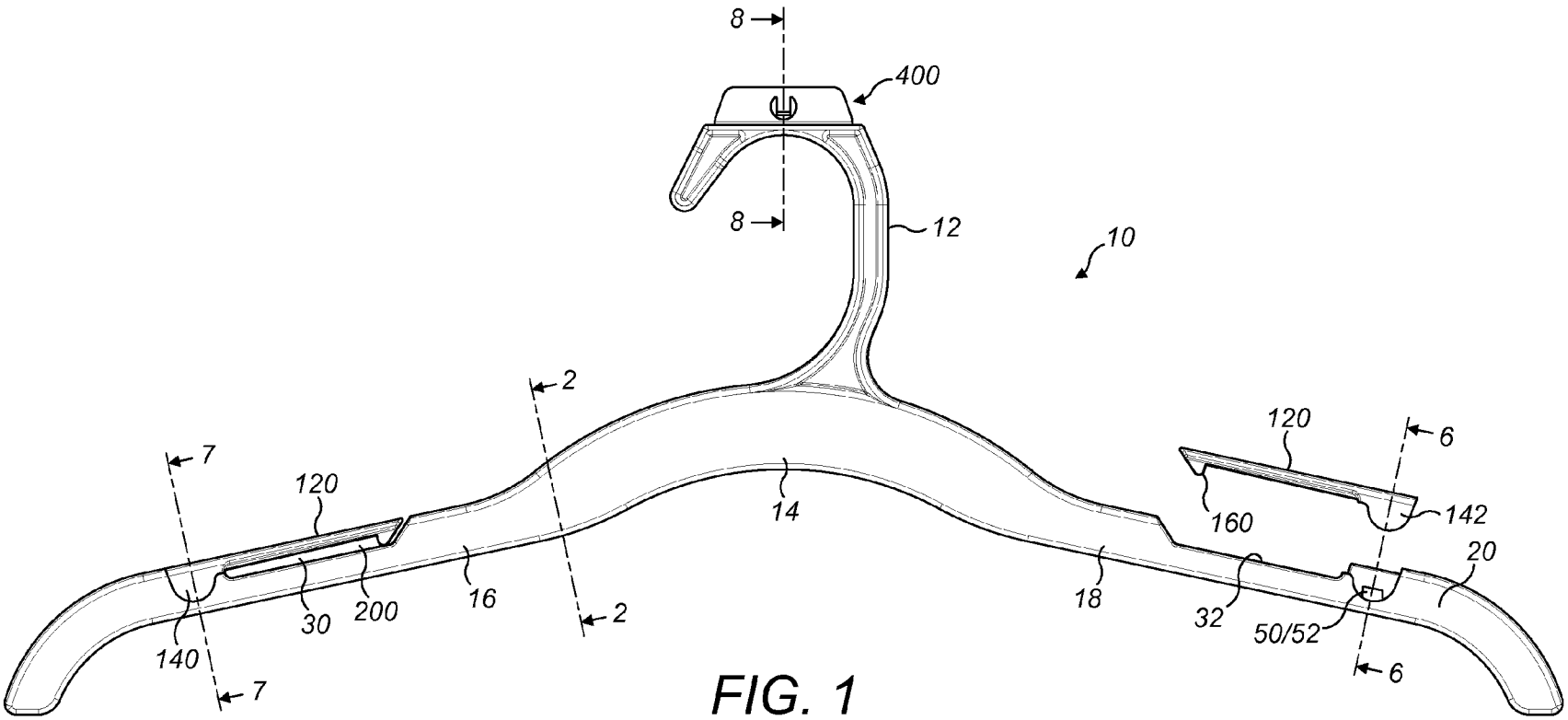
FIG. 1 is a front elevation view of a top garment hanger with reusable snap-on pads, according to an exemplary embodiment of the present invention.

Referring now in detail to the drawings, and particularly the hanger construction as shown in FIG. 1, there is illustrated a front elevation view of a molded plastic garment hanger 10, which includes a hook 12 and an elongated hanger body or beam 14. The hook is upstanding from the hanger body 14. The hanger body 14 includes a pair of coplanar and oppositely directed arms 16 and 18 for suspending one or more garments, as is well known in industry. The arms 16 and 18 may also extend downwardly from the hanger body 14 at the opposite distal ends of the hanger body.

Figure 2:
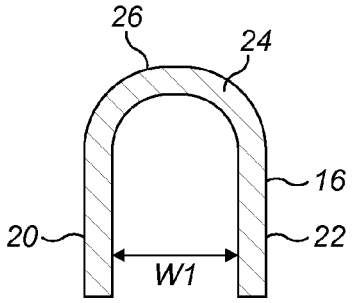
FIG. 2 is a sectional view of the hanger along lines 2-2 in FIG. 1.

As shown in FIG. 2, the hanger body 14 has U-shaped cross-section, which provide structural strength for the hanger 10 and support for garments. Other cross-sectional beam geometries, including 'I', 'square-m', and 'C', among others known in the art, may be substituted without departing from the scope of the invention. The hanger body 14 includes a first panel 20 (the front panel as shown in FIG. 1) and a second panel 22 (the rear panel as shown in FIG. 1). The top portion of the first panel 20 and the top portion of the second panel 22 are connected to each other by a top panel 24. The top panel 24 has a top surface 26, which supports a garment during the use of the hanger 10. The first panel 20 and the second panel 22 together define the width W1 of the hanger body 14 along the lateral direction.

Referring back to FIG. 1, a first recess 30 is formed in the first arm 16, which extends downwardly from the top surface 26 of the hanger body 14 to provide a space for receiving a portion of the garment, such as a strap of the garment. A same or similar second recess 32 is formed in the second arm 18 for providing a space for receiving a portion of the garment.

FIG. 1 also illustrates a pair of reusable snap-on pads 100 according to another exemplary aspect of the present invention. The reusable snap-on pads 100 are typically made of a rubbery material and can be operatively snapped onto the hanger arm 16 and the hanger arm 18, respectively. The rubbery reusable snap-on pads 100 provide an anti-slip mechanism for preventing garments, particularly heavy garments, from slipping off the garment hanger. Also, the reusable snap-on pads 100, when mounted to the hanger 10, provide a retaining mechanism for retaining straps of the garments. For example, the retaining mechanism can be in the form of a slot 200 disposed within the recess 30 or 32, between the pads 100 and the top of the hanger body 14.

Figure 3:
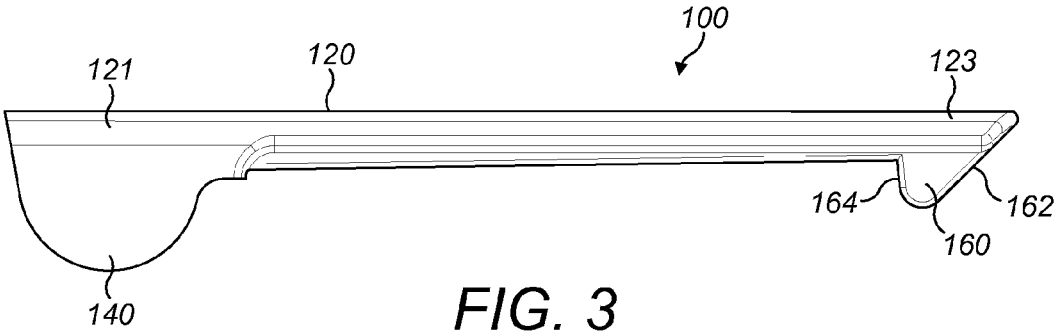
FIG. 3 is front elevation view of a reusable snap-on pad, according to another exemplary embodiment of the present invention.

FIG. 3 illustrates a front elevation view of the reusable snap-on pad 100. The reusable snap-on pad 100 includes an elongated body 120, a pair of first leg 140 and second leg 142 extending downwardly from the elongated body 120 and laterally distanced from each other, and a protrusion 160 extending downwardly from the elongated body 120. The pair of legs 140 and 142 are arranged at a first end 121 of the elongated body 120. The protrusion 160 is arranged at a second end 123 of the elongated body 120, which is opposite to the first end 121.

Both the first leg 140 and the second leg 142 are curved to have a substantially semi-circular profile. However, other profiles, such as triangle, rectangular, square, trapezoidal or elliptical, can be used without departing from the scope of the invention. The protrusion 160 is substantially triangular, having two slanted sides 162 and 164. For example, after the reusable snap-on pad 100 is mounted to the first arm 16, the first slanted side 162 functions to facilitate the insertion of a strap of a garment into the slot 200. The second slated side 164 functions to prevent accidental removal of the strap from the slot 200.

Figure 4:
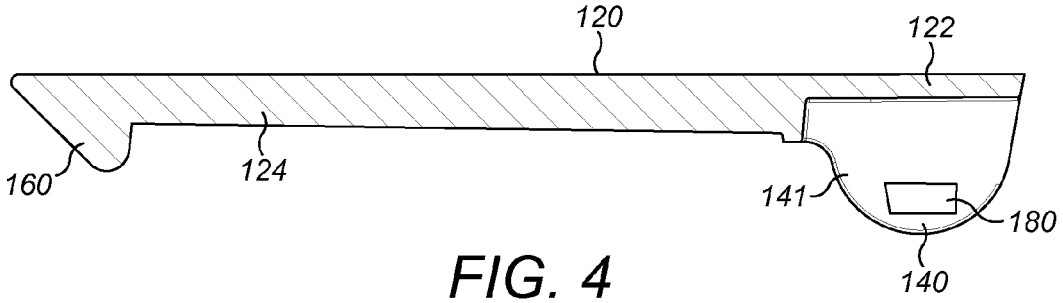
FIG. 4 is a rear elevation view of the reusable snap-on pad.

FIG. 4 is a rear elevation view of the reusable snap-on pad 100, with the second leg 142 removed to better illustrate the inner structure of the pad. The elongated body 120 includes a first portion 122 and a second portion 124, with the first portion 122 having a smaller thickness with respect to the second portion 124. The thinned first portion 122 provides more space below the elongated body 120, for the first leg 140 to readily engage a corresponding structure of the hanger arms.

Figure 5:
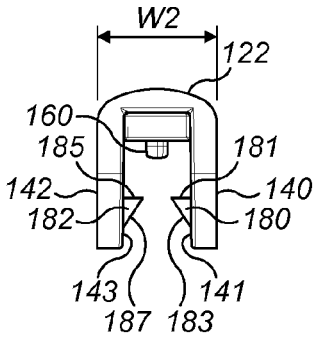
FIG. 5 is a side elevation view of the reusable snap-on pad.

The reusable snap-on pad 100 includes a first locking tab 180 disposed on the first inner surface 141 of the first leg 140 and a second locking tab 182 disposed on the second inner surface 143 of the second leg 142. Referring to FIG. 5, which illustrates a left side elevation view of the reusable snap-on pad 100 shown in FIG. 3, the first locking tab 180 includes a first locking surface 181, which is substantially horizontal and perpendicular to the first inner surface 141, and a first transitioning surface 183 angularly connecting the first locking surface 181 and the first inner surface 141. The second locking tab 182 may have same or similar configuration having a second locking surface 185 and a second transitioning slated surface 187 angularly connecting the second locking surface 185 and the second inner surface 143. However, the locking tabs, including the locking surfaces and the transitioning surfaces, can be varied without departing from the scope of the present invention.

The first leg 140 and the second leg 142 together define the width W2 of the reusable snap-on pad 100 along the lateral direction. For example, the lateral width W1 of the hanger body 14 is substantially equal to the lateral width W2 of the reusable snap-on pad 100, such that, when the reusable snap-on pad 100 is mounted to the hanger 10, a consistent and flat front surface and rear surface of the assembly can be achieved.

Figure 7:
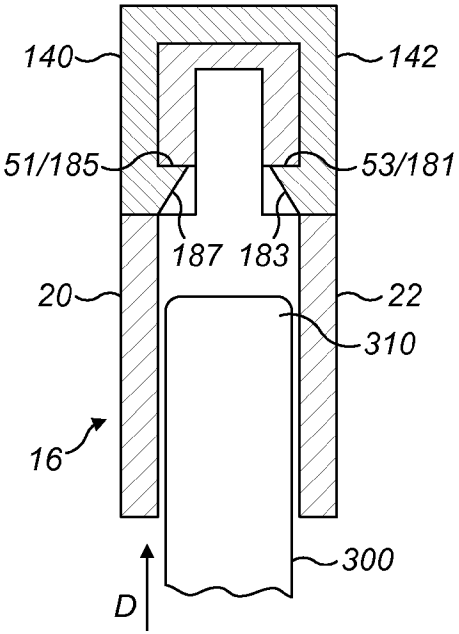
FIG. 7 is a sectional view of the hanger/pad along lines 7-7 in FIG. 1.
Figure 6:
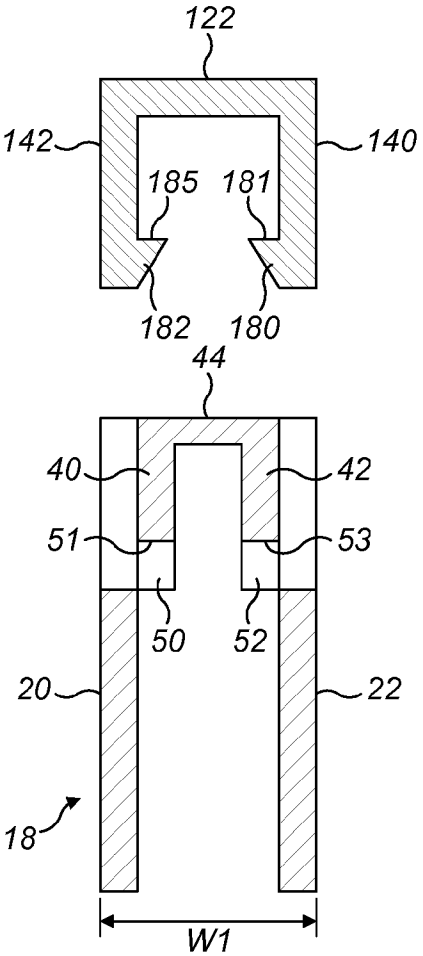
FIG. 6 is a sectional view of the hanger/pad along lines 6-6 in FIG. 1.

FIG. 6 is a sectional view of the hanger arm 18 along lines 6-6 in FIG. 1, which illustrates the mating structures of the hanger arm 18 and the reusable snap-on pad 100 before the pad is mounted to the hanger arm. FIG. 7 is a sectional view of the hanger arm 16 along lines 7-7 in FIG. 1, which illustrates the mating structures of the hanger arm 16 and the reusable snap-on pad 100 after the pad is mounted to the hanger arm.

As shown in FIG. 6, the hanger arm 18 includes a first inner panel 40 (the front inner panel) molded integrally with the first panel 20 and laterally internal of the first panel 120. The hanger arm 18 further includes an opposite second inner panel 42 (the rear inner panel), molded integrally with the second panel 22 and laterally internal of the second panel 122. The top portion of the first inner panel 40 and the top portion of the second inner panel 42 are connected to each other through an inner top panel 44, which is covered by the first portion 122 of the elongated body 120 of the reusable snap-on pad 100, after the reusable snap-on pad 100 is mounted to the hanger body 14.

A first lateral opening 50 is formed through the lateral dimension of the first inner panel 40. The first lateral opening 50 has a first inwardly extending surface 51, which functions as a locking surface to engage the second locking surface 185 of the second locking tab 182 of the reusable snap-on pad 100, as shown in FIG. 7. A second lateral opening 52 is formed through the lateral dimension of the second inner panel 42. The second lateral opening 52 has a second inwardly extending surface 53, which functions as a locking surface to engage the first locking surface 181 of the first locking tab 180 of the reusable snap-on pad 100, as shown in FIG. 7. The engagement between the locking surface of the lateral openings and the corresponding locking surface of the locking tabs implements a secure attachment of the snap-on pad to the hanger, which does not allow inadvertent and/or accidental removal of the pad from the hanger. Thus, the hanger product according to the present invention is children-proof.

The reusable snap-on pad 100 can be removed manually or automatically by using a tool, such as a rod 300 shown in FIG. 7. The rod 300 has a leading end 310, which can be inserted into the space between the first panel 20 and the second panel 22. The leading end 310 is dimensioned such that, as the rod 300 proceeds along the direction D, the leading end 310 operatively engages the transitioning surfaces 183/187 of the locking tabs 180/182 to resiliently expand the first leg 140 and the second leg 140 outwardly. As the rod 300 proceeds, the resilient expansion of the legs 140/142 spreads the locking surfaces 187/183 outwardly clear of the locking surfaces 51/53. Consequently, the reusable snap-on pad 100 is removed from the hanger 10.

The removed pads can be processed, such as, selected, cleaned, sorted and transported, for reuse purposes, according to a reuse methodology described in co-owned U.S. Pat. No. 6,523,240, in which hangers and indicators attached to the hangers are reused. For example, the hangers and pads can be manually or automatically selected, examined, separated, cleaned, sorted, transported, recycled and so on, for a reuse purpose. The different steps of the reuse method can be implemented at different geographic locations to enhance the processing efficiency. For example, different processing centers, such as a center designated for removing the pads and the hangers, can be set up for automatically implementing one or more of the reuse steps. The operations of the different centers can be controlled and coordinated through a computer system.

With the continuing consumption of the natural resources, it is popular and necessary in the manufacturing industry to optimize the product design to save materials and energy and, concomitantly, reduce the manufacturing and transportation costs, without compromising performance. The resultant product under such a material and energy saving concept is recognized as an environmentally friendly product, and is much more market competitive than its prior art counterpart. In the hanger molding industry, millions of plastic hangers and non-slip pads are manufactured each year. The removable characteristics of the pads with respect to the hangers would allow millions of pads and hangers to be collected and strategically reused. Thus, in view of the significant manufacture volume, reusable hangers and pads are environmentally friendly and provide a commercial advantage to the manufacturers, transporters and retailers in the industry.

Referring back to FIG. 1, the hanger 10 further includes an attaching means 400 formed at the top of the hook 12, for attaching a top sizer to the hanger 10. The attaching means 400 includes a horizontal flange 410 formed at the top the hook 12, upon which a top sizer is positioned to display garment-related information. The attaching means 400 further includes a vertical flange 420, extending upwardly substantially from the middle of the horizontal flange 410. The vertical flange 420 is adapted to be received within a cavity of the top sizer. The attachment means 400 further includes an opening 430, and a downwardly depending tab 440 extending out of the plane of the opening 430. The tab 440 has a lower surface 442 and an upper surface 444.

Figure 9:
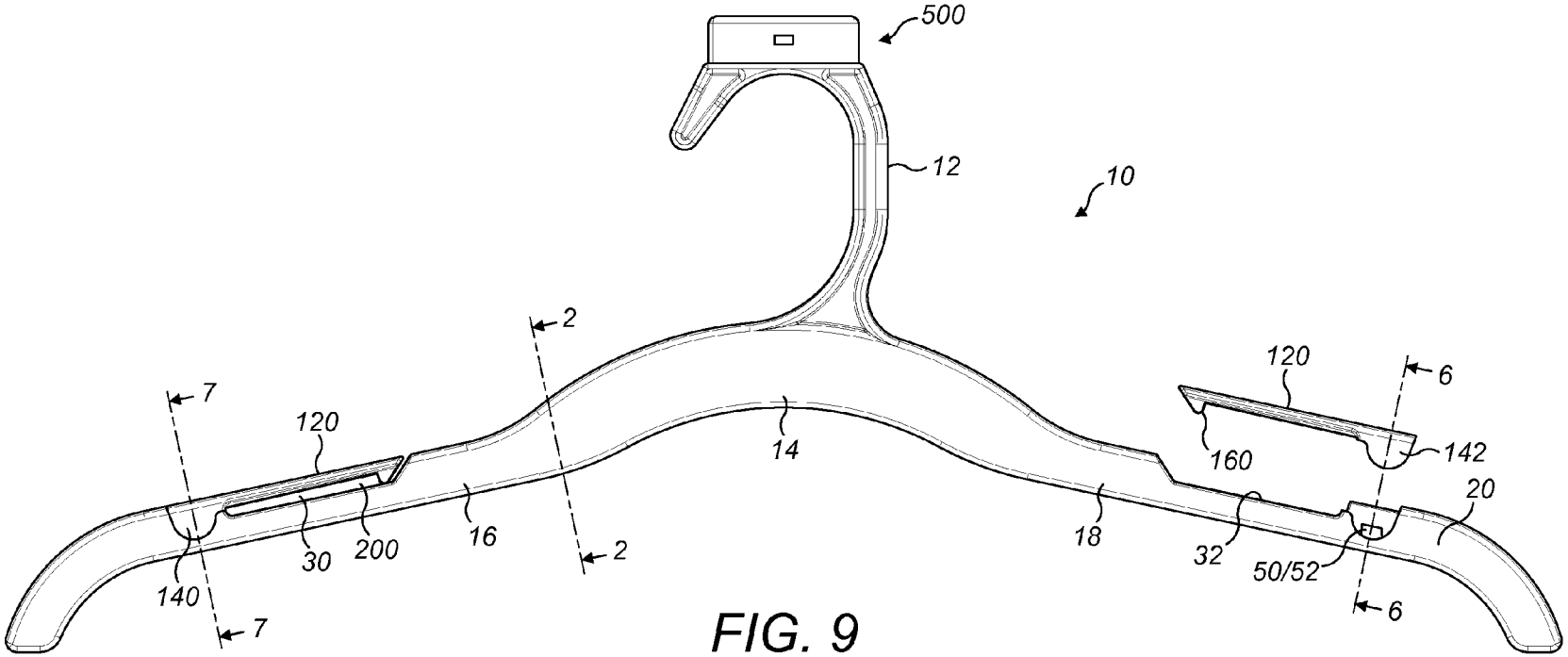
FIG. 9 is a front elevation view of a top garment hanger with reusable snap-on pads, according to yet another exemplary embodiment of the present invention.
Figure 11:
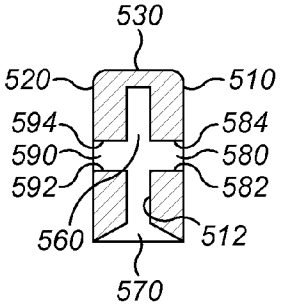
FIG. 11 is a sectional view of the top sizer along lines 11-11 in FIG. 10.
Figure 10:
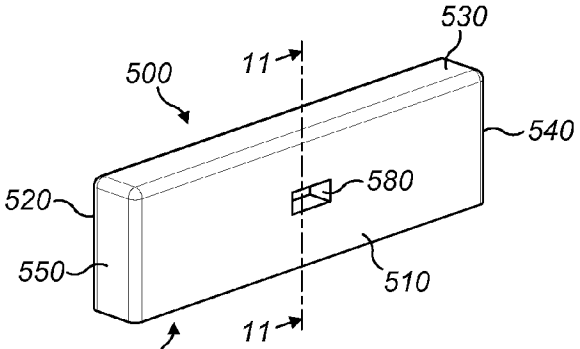
FIG. 10 is a perspective view of a top sizer used in connection with the top garment hanger in FIG. 9.

FIG. 9 illustrates a front elevation view of the hanger 10 with a top sizer 500 mounted thereon. FIG. 10 is a perspective view showing the structure of the top sizer 500. FIG. 11 is a sectional view of the sizer along lines 11-11 in FIG. 10.

The top sizer 500 includes a pair of opposite front wall 510 and rear wall 520, and a pair of opposite sidewalls 540 and 550, both connected with each other by a top wall 530. The front wall 510 and the rear wall 520 are substantially vertical and parallel to each other. The sidewalls 540 and 550 are substantially vertical and parallel to each other. The top wall 530 is substantially horizontal. Each of the above-mentioned walls can be used to provide a displaying surface, on which a size of a garment suspended by the hanger is printed or otherwise visible.

Figure 8:
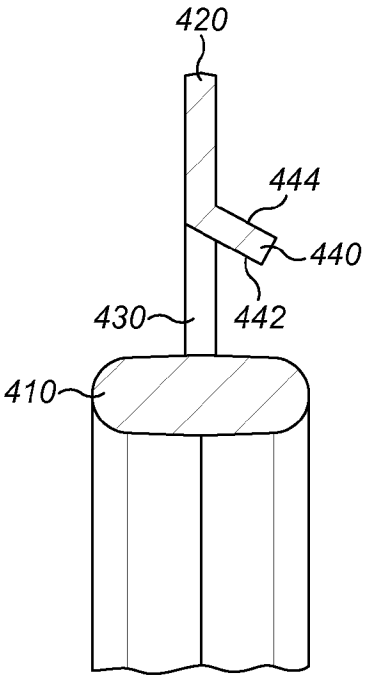
FIG. 8 is a sectional view of the hanger along lines 8-8 in FIG. 1.

The front wall 510, the rear wall 520, the sidewalls 540 and 550, and the top wall 530 generally define a blind receiving cavity 560, with an entrance 570 at the lower end of the sizer for admitting the vertical flange 420 of the sizer attaching means 400, shown in FIG. 8. The top sizer 500 further includes a pair of slots 580 and 590, formed in the front wall 510 and rear wall 520, respectively. The slots 580 and 590 are structurally symmetrical and functionally interchangeable with each other. The slot 580 comprises a lower surface 582 and an upper surface 584. The slot 590 comprises a lower surface 592 and an upper surface 594. Both the slots 580 and 590 are dimensioned and positioned to be complementary to the tab 440 of the sizer attaching means 400. During use, the top sizer 500 is handled to admit the vertical flange 420 of the sizer attaching means 400. As the top sizer 500 moves downwardly, the tab 440 engages the inner surface 512 of the front wall 510.

Due to the resilient nature of the tab 440, the tab 440 deflects to be received within the cavity 560. After that, the tab 440 projects into the slot 580 or 590. Consequently, the upper surface 444 of the tab 440 engages the upper surface 584 of the slot 580 or the upper surface 592 of the slot 590, and the lower surface 442 of the tab 440 engages the lower surface 582 of the slot 580 or the lower surface 592 of the slot 590. Accordingly, the top sizer 500 is secured to the hanger hook 12. The engagement between the tab 440 and the slot 480 or 490 prevents the top sizer 500 from being inadvertently or accidentally removed from the hanger hook 12. When it is desired to remove the top sizer 500 from the hanger hook 12, a tool, such as a rod, can be inserted into the slot 580 or 590 to release the engagement between the tab 440 and the slot 480 or 490.

The hanger of the present invention can be formed of one or more of may be one or more of polystyrene, SAN, ABS, PPO, nylon, polypropylene (PP), polyethylene, PET, polycarbonates (PC), acrylics, K-resin, and polyvinyl chloride (PVC) among others.

From the foregoing illustrations it is readily apparent that the present invention is directed to an improved top garment hanger suitable for industry mass production. The present invention offers reliable mechanical performance and structural integrity to the hangers, satisfying industry standards, such as, the VICS standards. Moreover, the production of such hangers is environmentally advantageous.

The present invention has been described with respect to certain exemplary embodiments. Certain alterations and/or modifications will be apparent to those skilled in the art, in light of the instant disclosure, without departing from the spirit or the scope of the invention. These embodiments are offered as merely illustrative, and not limiting, on the scope of the invention, which is defined solely with reference to the following appended claims.

I claim:

1. A garment hanger comprising:

a hook;

an elongated hanger body connected to the hook, the hanger body comprising a first arm and a second arm extending oppositely from the hook, the hanger body having a top surface for supporting a garment;

a recess formed in the hanger body, the recess extending downwardly from the top surface for providing a space into which a portion of the garment is received;

at least one lateral opening formed in the hanger body;

wherein the hanger body comprises a front panel and a rear panel, the top portions of the font panel and the rear panel being connected by a top panel providing the top surface of the garment hanger, thereby defining a substantially U-shaped hanger body; and wherein the at least one lateral opening is formed through the front panel and the rear panel to provide an inwardly extending surface in the front panel and the rear panel, respectively wherein each inwardly extending surface provides a locking surface configured to engage a non-slip pad.

2. The garment hanger according to claim 1, wherein the at least one lateral opening includes a first lateral opening formed in the first arm and a second lateral opening formed in the second arm.

3. The garment hanger according to claim 1, wherein the front panel and the rear panel each comprise a top portion and a bottom portion, wherein the top portion is disposed inwardly with respect to the bottom portion.

4. The garment hanger according to claim 3, wherein the at least one lateral opening is formed through the top portions of the front panel and the rear panel to provide the inwardly extending surface in the top portions of the front panel and the rear panel, respectively.

5. A reusable snap-on pad used with a garment hanger, comprising:

an elongated body having a first end and an opposite second end, wherein the first end comprises a first edge and a second edge, wherein the first edge and the second edge are substantially parallel to each other and define a distance that is substantially perpendicular to both the first edge and the second edge;

a pair of legs disposed at the first end of the elongated body and extending downwardly from the first edge and the second edge of the elongated body, respectively, the pair of legs being substantially parallel with each other and spaced from each other by the distance; and at least one locking tab disposed on an inner surface of the pair of legs, the at least one locking tab having a locking surface and a transitioning surface connecting the locking surface and the inner surface, wherein the at least one locking tab is provided at a lower terminal end of the inner surface.

6. The reusable snap-on pad according to claim 5, further comprising a protrusion disposed at the second end of the elongated body and extending downwardly from the elongated body.

7. The reusable snap-on pad according to claim 5, wherein the locking surface is substantially horizontal.

8. The reusable snap-on pad according to claim 6, wherein the pair of legs are curved to provide a substantially semi-circular profile and the protrusion is substantially triangular.

9. A combination of a garment hanger and a reusable snap-on pad, the hanger comprising:

a hook;

an elongated hanger body connected to the hook, the hanger body comprising a first arm and a second arm extending oppositely from the hook, the hanger body having a top surface for supporting a garment;

a recess formed in the hanger body, the recess extending downwardly from the top surface;

at least one lateral opening formed in the hanger body;

wherein the hanger body comprises a front panel and a rear panel, the top portions of the front panel and the rear panel being connected by a top panel providing the top surface of the garment hanger, thereby defining a substantially U-shaped hanger body; and wherein the at least one lateral opening is formed through the front panel and the rear panel to provide an inwardly extending surface in the front panel and the rear panel, respectively, wherein each inwardly extending surface provides a first locking surface, the reusable snap-on pad comprising:

an elongated body having a first end and an opposite second end;

a pair of legs disposed at the first end of the elongated body and extending downwardly from the elongated body, the pair of legs being substantially parallel with each other and spaced from each other by a predetermined distance; and at least one locking tab disposed on an inner surface of the pair of legs, the at least one locking tab having a second locking surface and a transitioning surface connecting the second locking surface and the inner surface, wherein, when the reusable snap-on pad is mounted to the garment hanger, the at least one locking tab enters the at least one lateral opening and the first locking surface and the second locking surface engage each other, to provide a secure fixation of the reusable snap-on pad to the garment hanger.

10. The combination according to claim 9, wherein the first locking surface and the second locking surface are substantially horizontal.

11. The combination according to claim 9, wherein, when the reusable snap-on pad is mounted to the garment hanger, the elongated body of the pad is disposed within the recess of the garment hanger to provide a slot between the pad and the garment hanger, into which a portion of the garment is received.

12. The combination according to claim 9, wherein the at least one lateral opening includes a first lateral opening formed in the first arm and a second lateral opening formed in the second arm.

13. The combination according to claim 9, wherein the front panel and the rear panel each comprise a top portion and a bottom portion, wherein the top portion is disposed inwardly with respect to the bottom portion.

14. The combination according to claim 13, wherein the at least one lateral opening is formed through the top portions of the front panel and the rear panel to provide the inwardly extending surface in the top portions of the front panel and the rear panel, respectively.

15. The combination according to claim 9, wherein the reusable snap-on pad further comprises a protrusion disposed at the second end of the elongated body and extending downwardly from the elongated body.

16. The combination according to claim 15, wherein the protrusion is substantially triangular and the pair of legs are curved to provide a substantially semi-circular profile.

* * * * *